US007313339B2

(12) United States Patent
Nishiyama

(10) Patent No.: US 7,313,339 B2
(45) Date of Patent: Dec. 25, 2007

(54) IMAGE FORMING DEVICE AND CONTROLLING METHOD THEREOF

(75) Inventor: Ryuji Nishiyama, Ibaraki (JP)

(73) Assignee: Canon Finetech Inc., Ibaraki (JP)

( * ) Notice: Subject to any disclaimer, the term of this patent is extended or adjusted under 35 U.S.C. 154(b) by 11 days.

(21) Appl. No.: 11/265,547

(22) Filed: Nov. 1, 2005

(65) Prior Publication Data

US 2006/0104652 A1 May 18, 2006

(30) Foreign Application Priority Data

Nov. 2, 2004 (JP) ..... 2004-318691

(51) Int. Cl.
*G03G 15/20* (2006.01)

(52) U.S. Cl. ..... 399/68; 399/69

(58) Field of Classification Search ..... 399/68, 399/69

See application file for complete search history.

(56) References Cited

U.S. PATENT DOCUMENTS 6,791,671 B1 * 9/2004 Hayashi et al. ..... 399/68 X
2003/0156853 A1 * 8/2003 Fukutani ..... 399/68
2004/0190924 A1 * 9/2004 Iwasaki et al. ..... 399/68

FOREIGN PATENT DOCUMENTS

JP 2003-330290 11/2003

* cited by examiner

*Primary Examiner*—David M. Gray
*Assistant Examiner*—Erika J. Villaluna
(74) *Attorney, Agent, or Firm*—patenttm.us; James H. Walters

(57) ABSTRACT

The temperature "t" sensed at the end in the longitudinal direction of a heater is compared with a threshold Th and, based on the comparison result, the print speed (throughput) is controlled. The threshold Th is switched according to a predetermined condition. For example, whether the number of times the throughput reduction, which switches the print speed to a lower speed, is executed has reached a predetermined number is used as the predetermined condition. Alternatively, whether the small-size-paper passing ratio is higher than a predetermined value is used as the predetermined condition. This prevents grease runoff, provides good slidability between a fixing film and the heater, solves problems of improper paper conveyance, sliding sound generation, and improper fixing, and improves the durability of a fixing device.

6 Claims, 9 Drawing Sheets

IMAGE FORMING DEVICE AND CONTROLLING METHOD THEREOF

DETAILED DESCRIPTION

1. Field of the Invention

The present invention relates to an image forming device having a fixing device, used for an image forming device such as a copier, a printer, and a facsimile, for heat-fixing an unfixed image on a recording material (recording paper), and to its control method.

2. Related Art

Conventionally, an image forming device is known that copies a toner image, formed by the image forming unit through xerography, onto recording paper, conveys the recording paper to the fixing device, and ejects the recording paper, on which an unfixed toner image is fixed, outside the device.

In such an image forming device, an endless belt-shaped fixing film is brought into contact with a heater fixed on the holding member, a recording material such as recording paper is brought into contact with the fixing film, and the pressure member is used to press the recording paper and the fixing film to move them forward by frictional force. This fixing method is characterized by quick heating.

In the configuration described above, heat-stable fluorine grease is used as a lubricant to reduce the sliding friction resistance between the fixing film and the heater. An increase in the friction resistance between the fixing film and the heater sometimes causes the pressure member to fail to convey the fixing film smoothly or generates a sliding sound. The lubricant, when used as described above, enables the pressure member to drive the fixing film and prevents the generation of a sliding sound.

One of the problems with the prior art described above is that the grease applied to the heater runs off the edges of the fixing film and runs onto the surface of the fixing film. For the early time after the heater is greased and assembled, the grease does not run off the fixing film. However, after the pressure member is assembled to press the fixing film and the print operation is performed to rotate the fixing film, the grease runs onto the whole face opposite to the face where the fixing film is in contact with the pressure member and the extra grease runs off the edges of the fixing film and then runs onto the surface.

Especially, when a narrow recording material is used for the print operation, the temperature in the non-paper-passage part rises and, as a result, the viscosity of the grease is greatly decreased and the grease tends to run off the edges. The grease built up between the film and the heater gradually solidifies if exposed to a high temperature for a long time. Because the fixing film wider than the pressure member has parts that do not touch the pressure member, the grease running onto the surface does not develop a problem immediately. However, a continued rotation causes the grease to gradually run into the center of the width of the fixing film until finally it touches the pressure member. A further continued rotation causes the pressure member to spread the grease all over the pressure member. As a result, the grease extremely decreases the conveyance force of the pressure member to rotate the fixing film and prevents the fixing film from rotating, with the result that the recording material cannot be conveyed through the nip part and a jam (paper jam) or a defective image is generated.

An attempt has been made to decrease the amount grease to prevent the grease from running off the edges. However, the amount of grease, if decreased too much, decreases the slidability between the fixing film and the heater and the sliding sound changes to an abnormal sound. In addition, the grease becomes insufficient so quickly that the device cannot be used long and, as a result, the durability is decreased.

Conversely, the amount of grease, if increased too much, causes the grease to run off the edges as described above and affects the conduction of heat to the recording material. Therefore, the temperature required for fixing cannot be supplied and a fixing failure is generated.

SUMMARY OF THE INVENTION

Therefore, it is an object of the present invention to provide an image forming device with a highly durable fixing device and its control method, wherein the fixing device prevents grease runoff, provides good slidability between a fixing film and the heater, and solves problems of improper paper conveyance, sliding sound generation, and improper fixing.

An image forming device according to the present invention comprises a heater; a heat conducting rotary body that conducts heat of the heater; and a pressure rotary body that presses on the heat conducting rotary body, wherein the image forming device heats and presses a recording material for fixing an unfixed image thereon with the recording material, on which the unfixed image is formed, nipped between the heat conducting rotary body and the pressure rotary body. The image forming device further comprises temperature adjusting means for maintaining the heater at a predetermined fixing temperature when the recording material is nipped for fixing; temperature sensing means for sensing a temperature of the heater; print speed control means for comparing the temperature sensed by the temperature sensing means with a predetermined threshold to control a print speed according to the comparison result; and threshold switching means for switching the threshold according to a predetermined condition.

The threshold of the temperature at the end for switching the print speed is switched according to the predetermined condition to switch the threshold from one temperature to a lower temperature as the state changes over time. This allows the image forming device to operate at high throughput when the performance of the grease slidability of the fixing device is high and, when the performance decreases, to compensate for the performance decrease at the sacrifice of throughput to some extent to improve the durability of the device.

More specifically, the image forming device further comprises counting means for accumulating the number of executions of throughput-reduction that is executed for reducing the print speed by the print speed control means, wherein, as the predetermined condition, the threshold switching means uses a condition that the number of executions of throughput-reduction, accumulated by the counting means, reaches a predetermined value.

Alternatively, the forming device further comprises means for sensing recording material size information; counting means for counting the number of recording material prints; and small-size-paper passing ratio measuring means for measuring a small size paper passing ratio of the number of prints of sheets of paper equal to or smaller than a predetermined size to the number of prints of paper of all sizes wherein, as the predetermined condition, the threshold switching means uses whether or not the small size paper passing ratio is higher than a predetermined value.

The present invention is advantageously applicable when a fixing film is used as the heat-conducting rotary body. In particular, even when small-size paper successively passes on an image forming device with a fixing device in which grease is used between the fixing film and the heater, the present invention can provide a highly durable image forming device that achieves grease sliding performance for a long time, provides good slidability between the fixing film and the heater, and solves problems of improper paper conveyance, sliding sound generation, and improper fixing.

DETAILED DESCRIPTION OF THE PREFERRED EMBODIMENTS

Preferred embodiments of the present invention will be described in detail below with reference to the drawings.

FIRST EMBODIMENT

Figure 4:
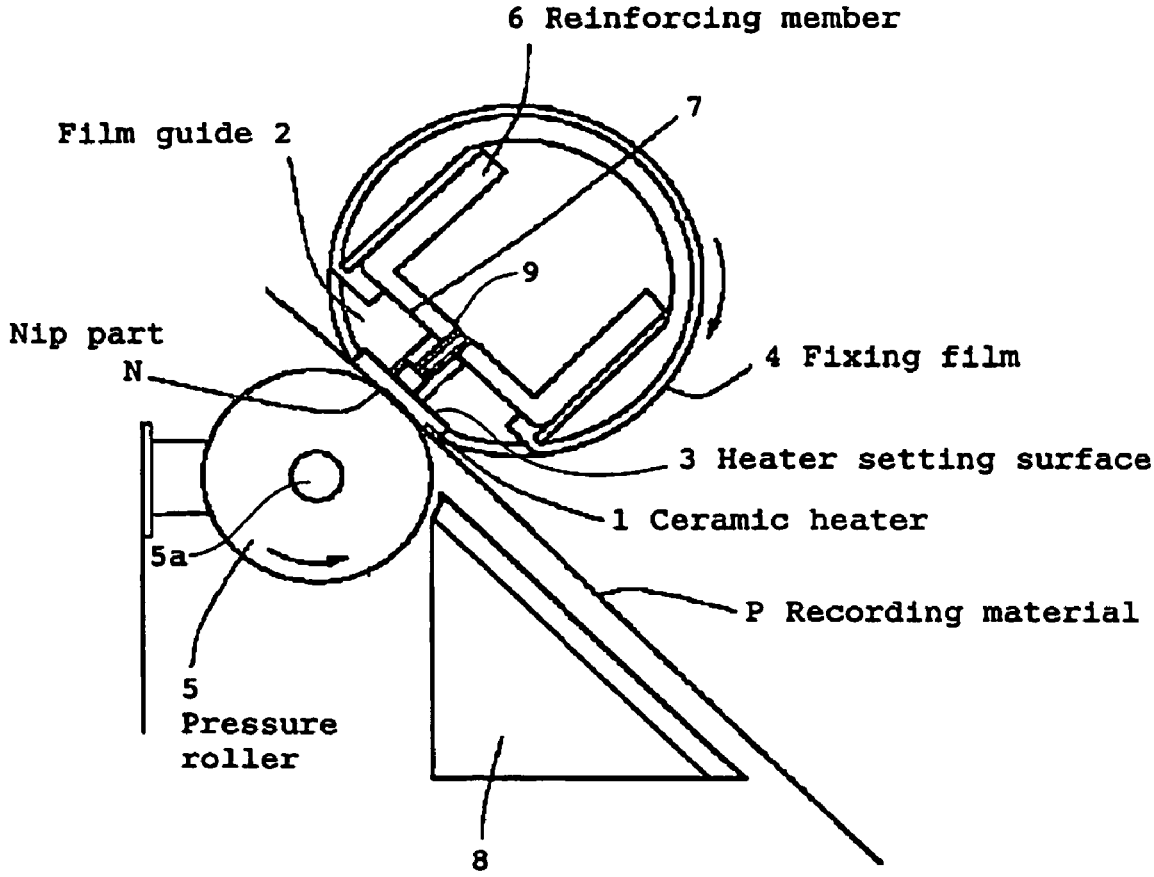
FIG. 4 is a diagram showing the general configuration of the fixing device in an embodiment of the present invention.
Figure 5:
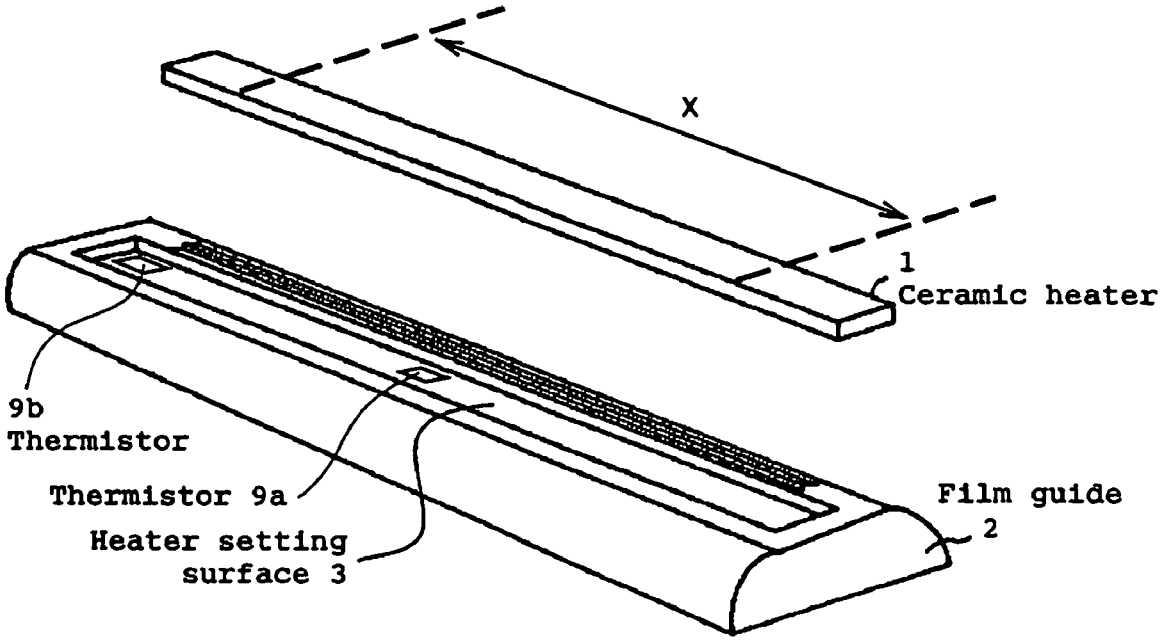
FIG. 5 is a diagram showing the enlarged view of a part of a film guide and a ceramic heater.

FIG. 4 is a diagram showing the general configuration of a fixing device in an image forming device in this embodiment, and FIG. 5 is a diagram showing the enlarged view of its part.

This fixing device uses a fixing film 4 as an example of a heat-conducting rotary body and has a ceramic heater 1, which is a heating element, fitted in a film guide 2 that works as a holding member. The ceramic heater 1 abuts on, and supported by, a heater setting surface 3 of the film guide 2.

In this embodiment, the ceramic heater 1 is formed by printing a heat resistor of silver palladium for 219 mm in the longitudinal direction squarely in the center of an aluminum substrate, which is 270 mm long, 7.8 mm wide, and 1.0 mm thick, so that the resistance becomes 24Ω. The endless belt-shaped fixing film 4, which is heated by the ceramic heater 1, is 24 mm in inside diameter and is composed of a polyimide base material, about 40 μm thick, on which the adhesive layer about 5 μm thick and the fluorocarbon resin surface layer about 10 μm thick are printed.

This fixing film 4 is held pressed between a pressure roller 5, which works as a pressure rotary body, and the ceramic heater 1 and is pushed forward to the ceramic heater 1 by the pressure roller 5 to form a nip part N. The pressure roller 5 is composed of an aluminum hollow rod 5*a* (Φ14) around which a 20 mm silicone rubber layer is formed with the surface coated by fluorine latex. The pressure roller 5 presses the film with a total pressure of 10.5 kg, and the heater setting surface 3 of the film guide 2 has a crown shape so that nip width is even between the center and the ends.

The hollow rod 5*a* of the pressure roller 5, supported rotatably by the plates on both sides of the fixing device, is driven by a driving device not shown. The pressure roller 5 rotates into the direction indicated by the arrow in FIG. 4 to cause the fixing film 4 to move in the reverse direction around the film guide 2. In addition, a reinforcing member 6, made of a metal plate and fixed on the film guide 2, is joined to a reinforcing member setting surface 7 of the film guide 2 with its surface in contact with the surface of the film guide 2. The film guide 2 and the reinforcing member 6 are guided by the plates on both sides of a fixing device, not shown, in the part projected on the both sides of the width of the fixing film 4. In this configuration, a recording material P conveyed from the upper stream of the conveyance direction is guided by an entrance guide 8 into the nip part N.

At this time, the fixing film 4, guided by the film guide 2 provided on its inside, is rotated by the pressure roller 5. When the recording material P enters the nip part N, it is heated by the heater 1 through the fixing film 4 and is pressed by the pressure roller 5 for fixing. After that, the recording material P, guided by a paper ejection guide not shown, is moved by a paper ejection roller, ejected outside the device by the paper ejection roller, and stacked on a paper election tray.

The following describes the contact surface between the heater 1 and the fixing guide 2 and that between the film guide 2 and the reinforcing member 6. The film guide 2 is made of heat-stable liquid crystal polymer. The reinforcing member 6, provided to prevent bending and creep deformation in the film guide 2 by the pressure roller 5, is produced by bending a metal plate into a horseshoe shape.

Next, as shown in FIG. 5, heat-stable fluorinated grease is applied on the heater 1 as a lubricant between the heater 1 and the fixing film 4 in the X range, 180 mm, squarely in the center in the longitudinal direction. The heat-stable grease used here is HP-300 grease from Dow Corning Asia composed of Perfluoropolyether used as the base oil and Polytetrafluoroethylene (PTFE) used as the viscosity enhancing agent. The grease, whose usage temperature ranges from −30° C. to 25° C., is usable for high temperature. Thermistors 9*a* and 9*b* are provided in the center and at the end of the heater setting surface 3 to sense the temperature.

Figure 6:
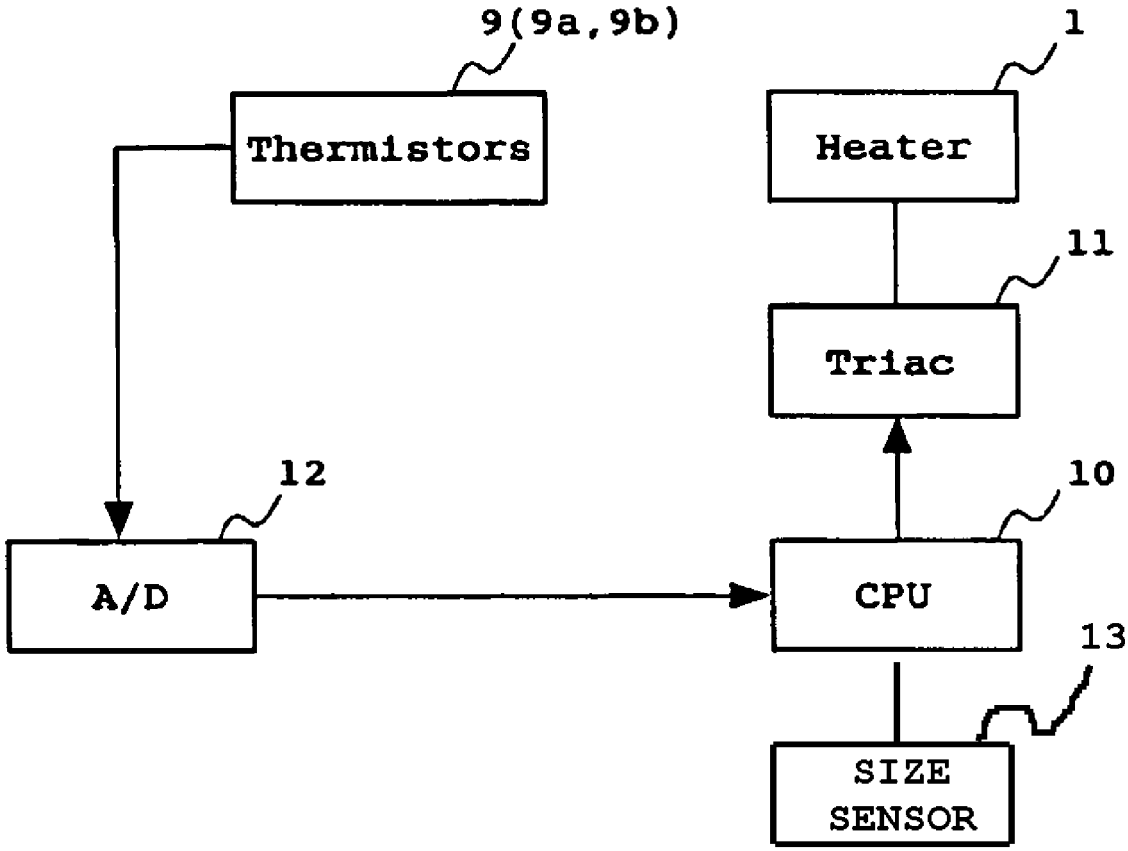
FIG. 6 is a block diagram showing the general configuration of control hardware for temperature control.

FIG. 6 is a diagram showing the general configuration of hardware for controlling the temperature. The outputs of the thermistors 9 (9*a* and 9*b*) in the center and at the end of the heater 1, respectively, are converted from analog to digital and are sent to the CPU 10. Based on the information, a triac 11 controls the power to be supplied to the heater by controlling the phase and the number of waves of the AC voltage to be supplied to the heater 1. "Temperature adjustment means" of the present invention comprises the CPU 10 and the triac 11. "Temperature sensing means" comprises the thermistors 9*a* and 9*b*. "Print speed control means", "counting means", and "threshold switching means" comprise the CPU 10.

Figure 1:
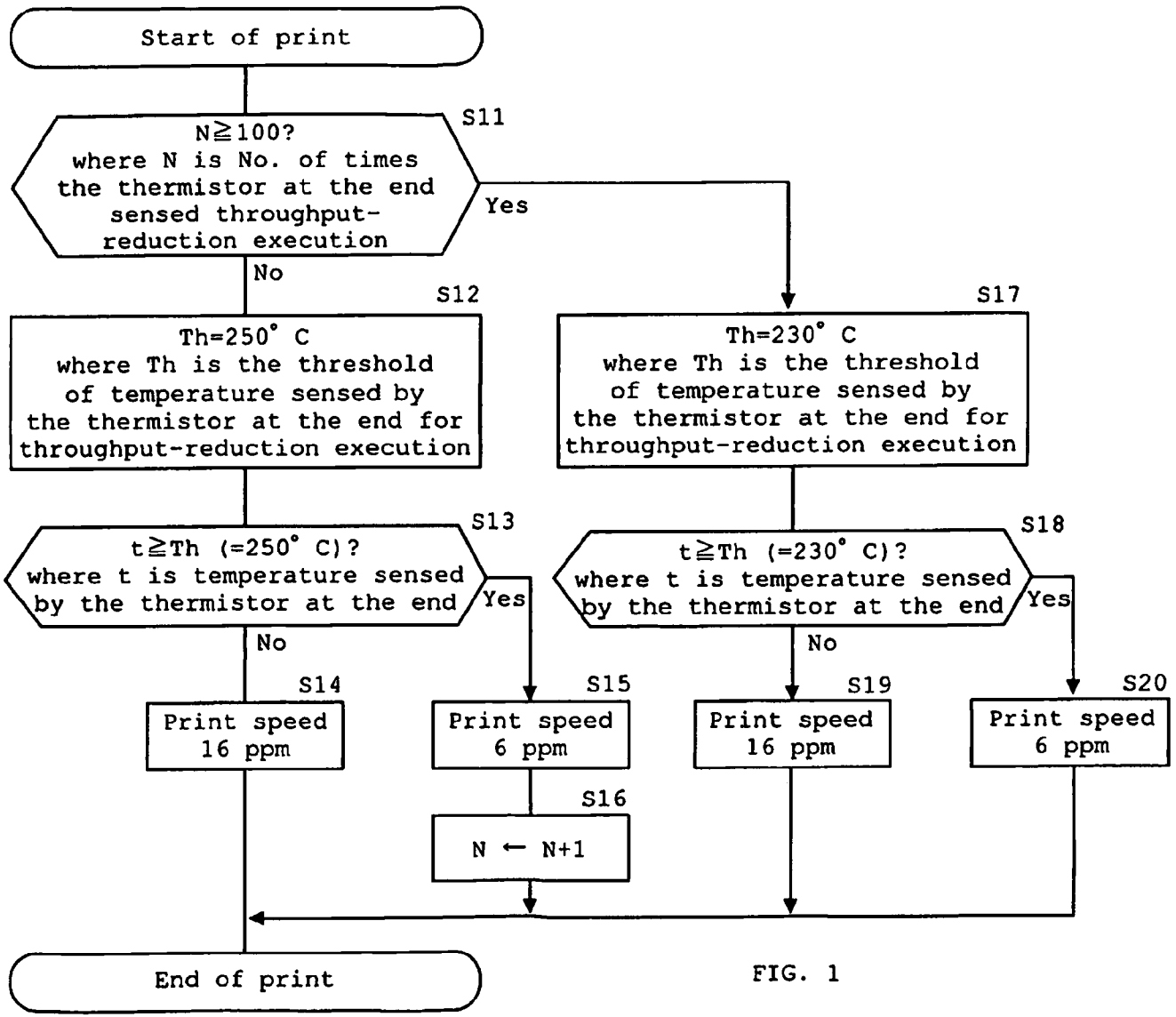
FIG. 1 is a flowchart showing the general operation of a control procedure for an image forming device of the present invention.

FIG. 1 is a flowchart showing the general control procedure for the image forming device in this embodiment. Table 1 lists the relation between the number of times the thermistor at the end senses the throughput-reduction temperature and the temperature sensed by the thermistor at the end for throughput reduction.

TABLE 1

| No. of times thermistor at the end senses throughput-reduction temperature | Threshold of temperature sensed by thermistor at the end for throughput-reduction |
|---|---|
| 1-100 | 250° C. |
| 101- | 230° C. |

The CPU 10 in FIG. 6 reads a program stored in the memory attached to the CPU 10 and executes the print operation shown in FIG. 1. The same is true of the print operation shown in the other flowcharts that will be shown later. The processing in FIG. 1 is started when the main body of the image forming device receives the print signal. First, the program checks the number of times, N, the print speed (i.e., throughput) reduction temperature was sensed (number of times, N, the throughput-reduction execution was sensed) by the thermistor provided at the end of the heater for sensing a rise in the temperature of the non-paper-passage part when a narrow recording material successively passes through the main body (S11). In this example, the program checks if N≧100. If the number of times the thermistor 9*b* at the end sensed the throughput-reduction temperature is 75 (S11, No), the throughput-reduction temperature threshold Th is set to 250° C. (S12). If the number of times the thermistor sensed the throughput-reduction temperature is 125 (S11, Yes), the throughput-reduction temperature threshold Th is set to 230° C. (S17).

For the period of time before the throughput-reduction temperature is set in the main body but before the temperature "t" sensed by the thermistor 9*b* at the end becomes equal to or higher than the temperature threshold Th for executing throughput-reduction as a result of a temperature rise in the non-paper-passage part through which a narrow recording material passes successively (No in S13 or No in S18), the print speed at which the recording material is ejected from the main body per minute (hereinafter called ppm) is set to the first speed (in this example 16: 16 ppm) (S14, S19). If the print operation continues for some time and the thermistor 9*b* at the end senses that the temperature t becomes equal to or higher than the throughput-reduction temperature threshold Th that was set as described above (Yes in S13 or Yes in S18), the throughput is reduced to the second print speed (in this example, 6 ppm) (S15, S20).

When step S15 is executed, the accumulated number of throughput-reduction executions N is incremented (S16). This value is stored non-volatilely even after the device power is turned off.

Figure 2:
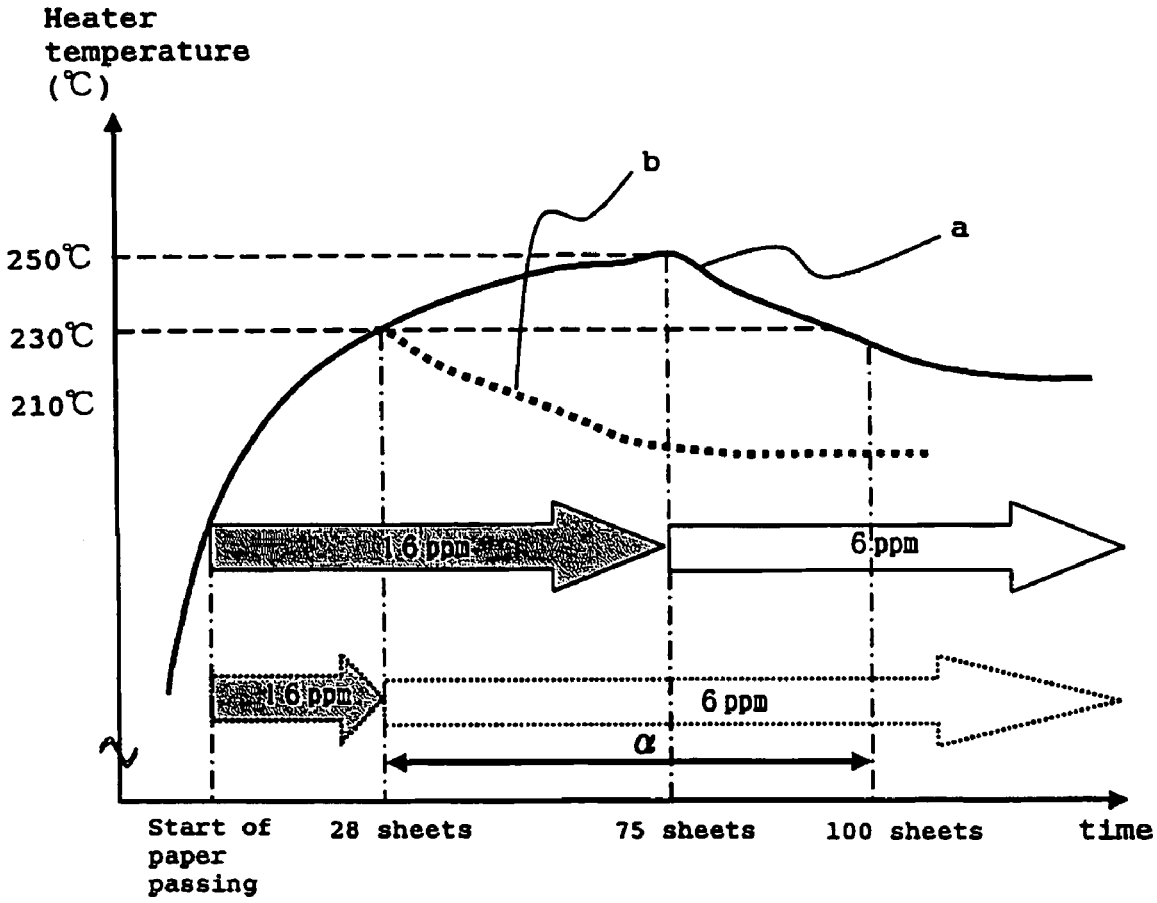
FIG. 2 is a graph showing a change in the temperature of the end of a heater when A5-size paper (64 gram), which is an example of a relatively wide recording material, successively passes through a fixing device, beginning with the state in which the fixing device is not heated.

FIG. 2 shows how the temperature at the end of the heater changes when A5-size paper (64 gram paper), an example of relatively narrow recording material, successively passes through the fixing device that is initially non-heated. As shown in the figure, the curve "a" indicates that the temperature sensed in the non-paper-passage part rises to 250° C. when 75 sheets of paper has passed and begins to fall after the throughput-reduction operation begins with the 76th paper. The curve "b" indicates that the temperature sensed in the non-paper-passage part rises to 230° C. when 28 sheets of paper has passed and begins to fall after the throughput-reduction operation begins with the 29th paper.

Figure 3:
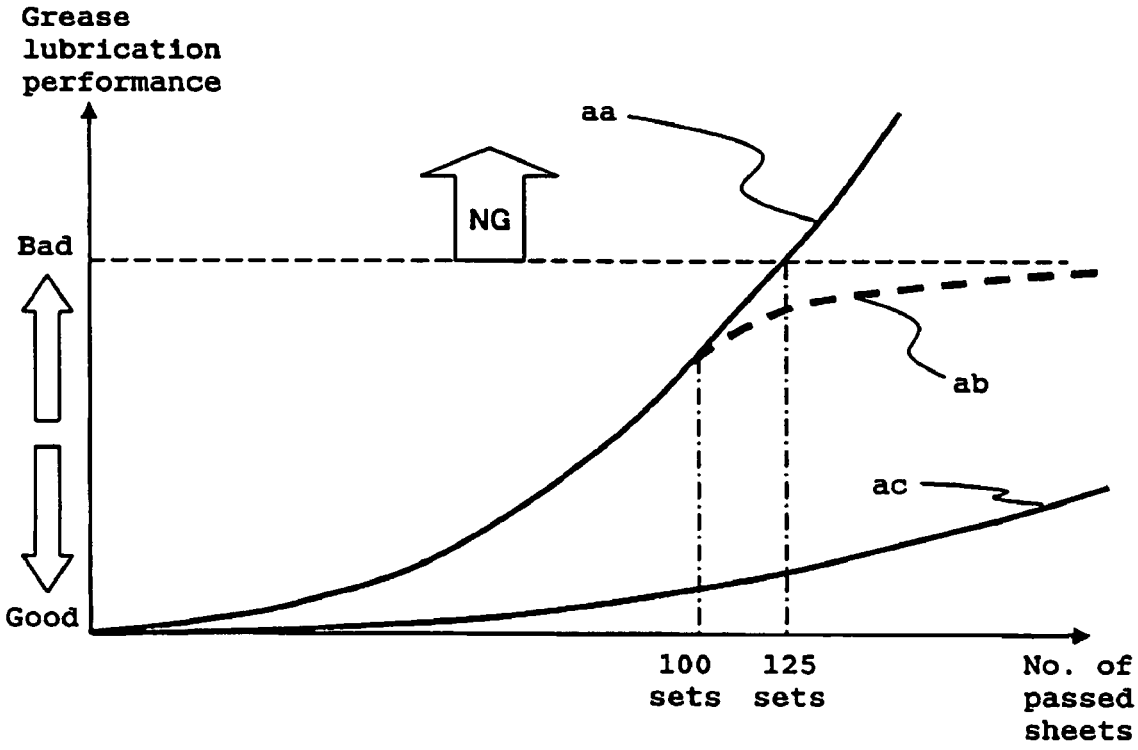
FIG. 3 is a graph showing the measurement result of the performance of specific grease on a conventional fixing device and that on the fixing device of the present invention.

FIG. 3 is a graph showing the measurement result of the performance of the MOLYKOTE HP-300 grease on the conventional fixing device and that on the fixing device in this embodiment. This measurement was made by repeatedly passing A5-size paper (64 gram), one hundreds of paper as one set, beginning with the state in which the fixing device is not heated. The curve "aa" indicates the change in the performance when paper passes through the conventional fixing device. The curve "ab" indicates the change in the performance when paper passes through the fixing device in this embodiment. The curve "ac" indicates the change in the performance when the throughput-reduction temperature is initially set at 230° C.

The comparison of those curves indicates that, approximately when about 125 sets of paper have passed, the grease begins to solidify on the conventional fixing device and therefore cannot achieve lubrication performance. This is because the accumulated time used under high temperature, that is, the accumulated time used under the high temperature of 230° C.-250° C. (that is, the paper passing time a shown in FIG. 2), is long because the throughput-reduction temperature at the end remains set to 250° C. In the fixing device in this embodiment, the temperature threshold is set to 250° C. until the throughput-reduction temperature is sensed 100 times at the end and, from the 101st time, the temperature threshold is switched to 230° C. Therefore, when the accumulated number of sheets increases, the switching described above keeps the temperature below 230° C. at the end and brings down the usage temperature of the grease at the end to prevent the grease from being solidified.

When the temperature threshold for throughput reduction is set to 230° C., the grease can achieve lubrication performance for a long time but reduces productivity when a small-size recording material passes through the fixing device. This is undesirable.

Therefore, switching the threshold of the temperature sensed at the end for throughput reduction in this way achieves good grease performance at the end for a long time by applying grease not generously but adequately, thus providing a highly durable fixing device that provides good slidability between the fixing film and the heater. The number of times "100" used in the above example means, not that the accumulated number of sheets is simply increased, but that the number of actual throughput-reduction executions has reached a predetermined number of times. This number is one of measures indicating that it is desirable to bring the threshold temperature down to prevent the grease from being further degraded. The number "100" does not have a special meaning, and any other number maybe used.

SECOND EMBODIMENT

Figure 7:
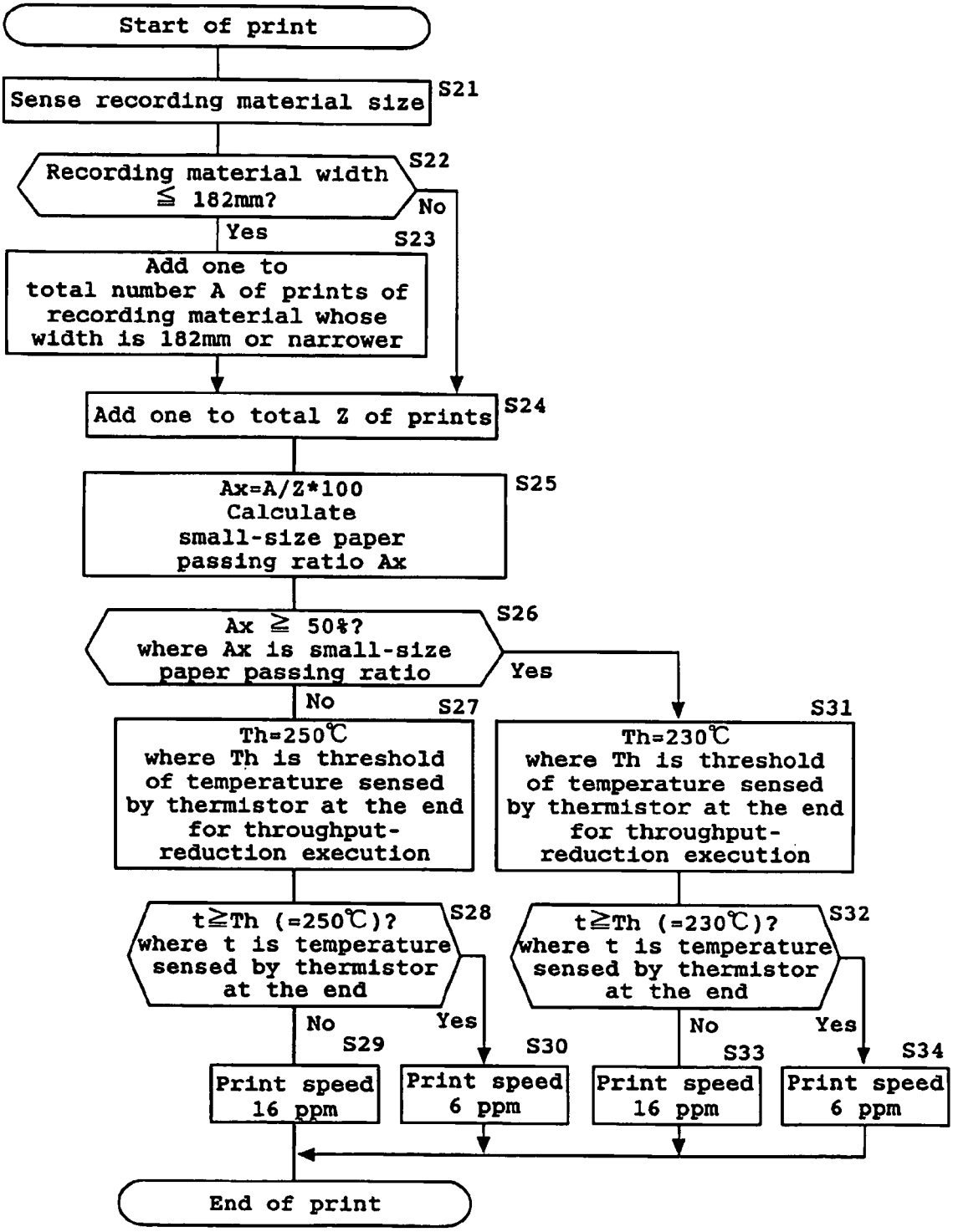
FIG. 7 is a flowchart showing the general operation of a control procedure for an image forming device in an embodiment of the present invention.

The general description of a fixing device is omitted because it is the same as that in the first embodiment described above. FIG. 7 is a flowchart showing the general operation of a control procedure for the operation of an image forming device in this embodiment. Table 2 lists the relation between the paper passing ratio of a small-size recording material and the threshold of the temperature Th sensed by thermistor at the end for throughput reduction.

TABLE 2

| Small size paper passing ratio Ax | Threshold of temperature sensed by thermistor at the end for throughput-reduction |
|---|---|
| Ax ≧ 50% | 230° C. |
| Ax < 50% | 250° C. |

In the processing shown in FIG. 7, the main body of the image forming device starts print operation when it receives the print signal. Means for sensing the length of a recording material P in the width direction, for example, a size sensor 13 material P in the width direction, for example, a size sensor 13 provided on the main body cassette not shown, detects the width and the length of the recording material P to be printed and checks if the width of the recording material P is equal to or narrower than 182 mm (S22). If the width of the recording material P is equal to or narrower than 182 mm, one is added to the total number A of prints of recording material P whose width is 182 mm or narrower (S23), stored in the main body storage means not shown, and, at the same time, one is added also to the total number Z of prints on the main body (S24). If the width of the recording material P is longer than 182 mm, step S23 is bypassed and one is added to the total number Z of prints (S24) Although not related directly to the present invention, the number of prints of the recording material P, whose size is sensed, can also be counted separately for each job.

Using the total number Z of prints and the total number A of prints of 182 mm or narrower recording materials P, the small-size-paper-total paper passing ratio Ax is calculated from the calculation expression Ax=A/Z*100 (S25). From the value obtained from this calculation, the threshold of the temperature Th sensed by the thermistor at the end for throughput reduction is determined to be 250° C. or 230° C. (S27, S31) based on the paper passing ratio of small-size recording material whose width is 182 mm or narrower (small-size paper passing ratio) Ax in Table 2 stored in the main body (S26). Although the threshold to be compared with the small-size paper passing ratio Ax is 50% in this example, the threshold is not limited to this value. For the period of time after the moment throughput-reduction threshold temperature Th is set in the main body but before the moment the temperature "t" sensed by the thermistor at the end becomes equal to or higher than the threshold of the temperature Th for executing throughput reduction, which was set as described above, as a result of a temperature rise in the non-paper-passage part through which a narrow recording material passes successively (No in S28 or No in S32), the print speed of the print operation, at which the recording material is ejected from the main body per minute, is set to the first speed (in this example 16: 16 ppm) (S29, S33). If the print operation continues for some time and the thermistor at the end senses that the temperature "t" becomes equal to or higher than the throughput-reduction temperature threshold Th that was set as described above (Yes in S28 or Yes in S32), the throughput is reduced to the second print speed (in this example, 6 ppm) (S30, S34).

Figure 8:
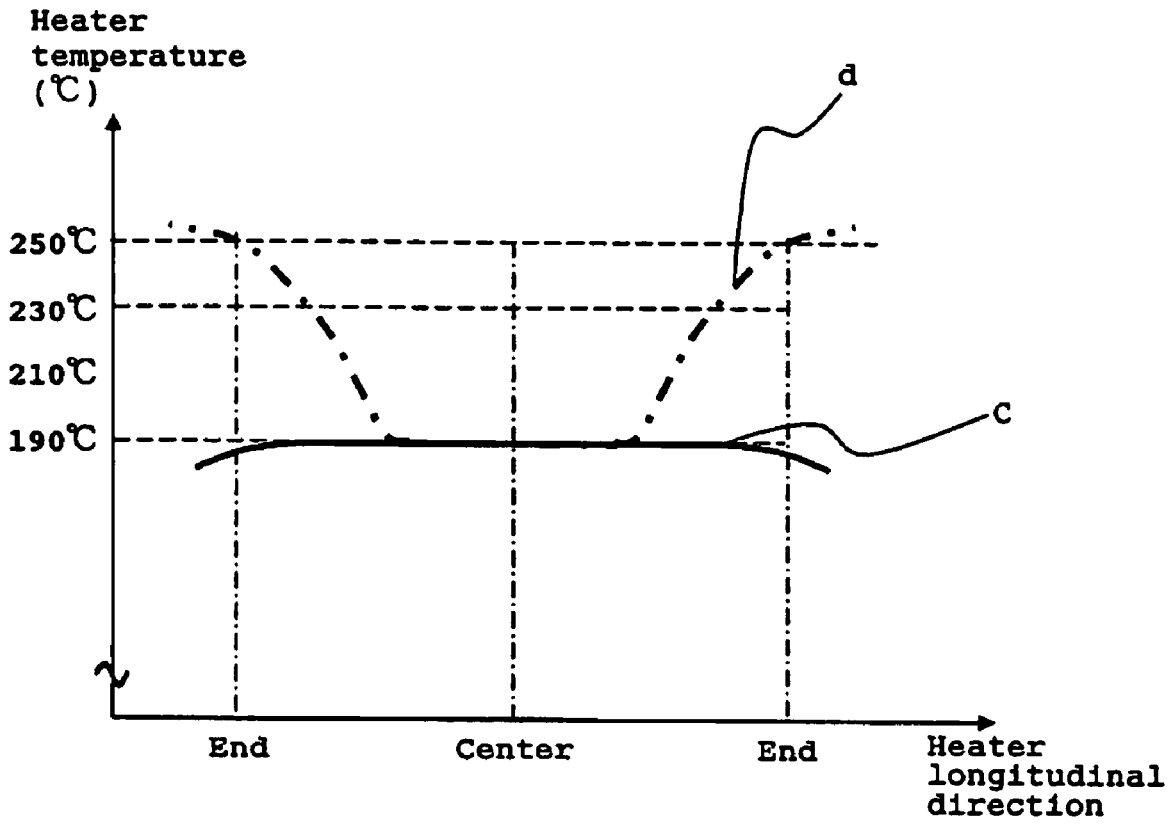
FIG. 8 is a graph showing the temperature distribution in the longitudinal direction of the heater when 70 sheets of different-size recording materials P successively pass.

FIG. 8 is a diagram showing the temperature distribution in the longitudinal direction of the heater when 70 sheets of different-size recording material P pass successively. The curve "d" shows the temperature distribution for the B5-size recording material P whose width is 182 mm. In the position where the recording material P passes, the conduction of the heater 1 is controlled to maintain the temperature of 190° C. that is controlled based on the thermistor 9*a*. Therefore, the heat of the heater 1 is not removed in the position where the recording material P does not pass and, therefore, the temperature in the non-paper-passage part rises. The curve "c" shows the temperature distribution for the A4-size recording material P whose width is 210 mm. Because the position where the recording material P passes is almost equal in length to the whole length of the heat resistor of the heater 1, there is no position where the heat of the heater 1 is not removed because the recording material P is not present and therefore the temperature does not rise in any position. That is, the temperature of 190° C. controlled based on the thermistor 9*a* is maintained across the whole longitudinal direction.

In the temperature distribution in the longitudinal direction of the heater indicated by the curve "d" as shown in FIG. 8, the viscosity of the heat-stable grease applied in the application range X, 180 mm in length, between the fixing film 4 and the heater 1 as shown in FIG. 5 is reduced in the center and the grease moves gradually to the ends. In addition, the viscosity of the grease moved to the ends is further reduced with the result that the grease runs from within the fixing film 4. A small amount of grease built up at the ends solidifies if exposed to a high temperature for a long time and does not achieve lubrication performance.

In the temperature distribution in the longitudinal direction of the heater indicated by the curve "c", there is almost no difference in temperature between the center and the ends and the viscosity of the grease is almost even. Therefore, only a small amount of grease runs off the fixing film 4 and the grease stays long between the fixing film 4 and the heater 1.

Figure 9:
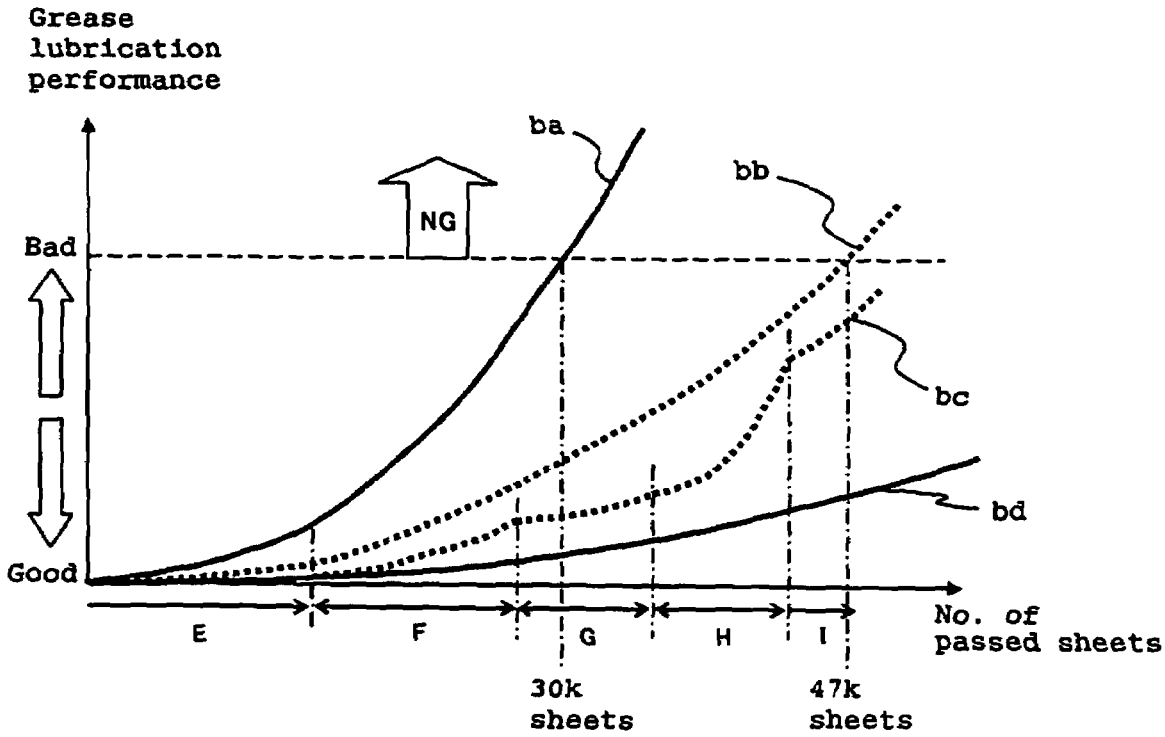
FIG. 9 is a graph showing a change in the lubrication performance of heat-stable grease when uniform-size or different-size recording materials P successively pass on the image forming device of the present invention and on the conventional image forming device.

FIG. 9 is a diagram showing a change in the lubrication performance of the heat-stable grease (MOLYKOTE HP-300 described above, Dow Corning Corporation) when a uniform-size or different-size recording material P successively passes through the image forming device in this embodiment and the conventional image forming device. The curve "ba" shown in FIG. 9 indicates the grease lubrication performance when 100 sheets of B5-size paper successively pass through the conventional image-forming device repeatedly. The temperature sensed by the thermistor 9*b* at the end for throughput reduction is always set to 250° C. The curve shows that, in this state, the grease at the end solidifies when a total of 30 k sheets (30,000 sheets) of paper have passed and the grease does not achieve the lubrication performance. In contrast, on the image-forming device in this embodiment, the small-size-paper passing ratio Ax becomes equal to or higher than 50% from the calculation result as shown by the curve "bb" when a first print job is executed. As a result, the threshold of the temperature Th sensed by thermistor 9*b* at the end for throughput reduction is set to 230° C. from the next job. The result is that the grease at the end can achieve the lubrication performance for the 47 k sheets of paper. The curve "bd" indicates the grease lubrication performance when 100 sheets of A4-size paper successively pass through the image-forming device in this embodiment repeatedly. In this state, the temperature is distributed evenly in the longitudinal direction of the heater 1 as described above and, thus, the grease is not used under a high temperature. Therefore, the grease at the end or in the center can achieve the lubrication performance for a long time. In addition, the curve "bc" indicates the grease lubrication performance when A4-size and B5-size paper successively passes through the image-forming device in this embodiment repeatedly. 13 k sheets of A4-size paper pass in period E, and 13 k sheets of B5-size paper in period F. Because the small-size-paper passing ratio Ax in those periods is lower than 50%, the threshold of the temperature sensed by thermistor 9*b* at the end for throughput reduction is set to 250° C. The threshold of the temperature for throughput reduction remains set to 250° C. for 8 k sheets of A4-size paper again in period G, and for 8 k sheets of B5-size paper in period H that follows. In period I, the print operation is performed with the temperature threshold for throughput reduction set to 230° C.

The comparison of the changes described above indicates that, when B5-size paper successively passes through the conventional image forming device, the grease begins to solidify after about 30 k sheets have passed and the grease does not achieve the lubrication performance. This is because the accumulation time during which the grease is used under a high temperature is long; that is, because the threshold of the temperature sensed at the end for throughput reduction remains set to 250° C., the end is used for a long time under a high temperature of about 250° C. as shown in FIG. 8. In contrast, the small-size-paper passing ratio is calculated on the image forming device in this embodiment and the temperature is set to 250° C. when the calculated ratio Ax is lower than 50%, and to 230° C. when Ax is 50% or higher. When the small-size-paper passing ratio goes up, the image forming device in this embodiment brings the temperature at the end down to 230° C. to decrease the usage environment temperature of the grease at the end for slowing the progress of grease solidification.

Therefore, switching the threshold of the temperature sensed at the end for throughput reduction in this way achieves good grease performance at the end for a long time by applying grease not generously but adequately, thus providing an image forming device with a highly durable fixing device that minimizes productivity loss and provides good slidability between the fixing film and the heater.

The first embodiment and the second embodiment differ in the following point. In the first embodiment, the threshold Th once changed (reduced) is never returned to the original value unless the number of times the throughput reduction temperature is sensed is reset to N, for example, by exchanging the fixing device. In the second embodiment, the threshold Th once changed may be returned to the original value depending upon a changed in the paper-passing ratio Ax.

According to the present invention, the image forming device has a fixing device comprising a heater, a heat-conducting rotary body that conducts the heat of this heater, and a pressure rotary body that presses this heat-conducting rotary body. This image forming device, designed to adjust the balance between throughput and mechanical performance, increases throughput when the performance is high and decreases throughput when the performance is low. Therefore, the image forming device can compensate for performance degradation and, at the same time, improve the durability of the fixing device and, as a result, prolong the life.

Although the preferred embodiments of the present invention have been described, it is to be understood that, in addition to those described above, various changes and modifications may made. For example, the value and materials used in the above description for the temperature, number of sheets, print speed, number of prints, paper passing ratio, length, pressure, and resistance are exemplary only. The present invention is not limited to those values.

The invention claimed is:

1. An image forming device comprising:

a heater;

a fixing film that conducts heat of said heater; and a pressure rotary body that presses on said fixing film;

wherein said image forming device heats and presses a recording material for fixing an unfixed image thereon with the recording material nipped between said fixing film and said pressure rotary body, said unfixed image formed on the recording material, said image forming device further comprising:

temperature adjusting means for maintaining said heater at a predetermined fixing temperature when the recording material is nipped for fixing;

temperature sensing means for sensing a temperature of said heater;

print speed control means for comparing the temperature sensed by said temperature sensing means with a predetermined threshold to control a print speed according to the comparison result;

threshold switching means for switching the threshold according to a predetermined condition; and counting means for accumulating the number of executions of throughput reduction, said throughput reduction being executed for reducing the print speed by said print speed control means;

wherein, as the predetermined condition, said threshold switching means uses a condition that the number of executions of throughput reduction, accumulated by said counting means, reaches a predetermined value.

2. An image forming device comprising:

a heater;

a fixing film that conducts heat of said heater; and a pressure rotary body that presses on said fixing film;

wherein said image forming device heats and presses a recording material for fixing an unfixed image thereon with the recording material nipped between said fixing film and said pressure rotary body, said unfixed image formed on the recording material, said image forming device further comprising:

temperature adjusting means for maintaining said heater at a predetermined fixing temperature when the recording material is nipped for fixing;

temperature sensing means for sensing a temperature of said heater;

print speed control means for comparing the temperature sensed by said temperature sensing means with a predetermined threshold to control a print speed according to the comparison result;

threshold switching means for switching the threshold according to a predetermined condition;

means for sensing recording material size information;

counting means for counting the number of recording material prints; and small-size-paper passing ratio measuring means for measuring a small size paper passing ratio of the number of prints of sheets of paper equal to or smaller than a predetermined size to the number of prints of paper of all sizes;

wherein, as the predetermined condition, said threshold switching means uses whether or not the small size paper passing ratio is higher than a predetermined value.

3. A control method for an image forming device comprising a fixing film and a pressure rotary body that presses on the fixing film wherein said image forming device heats and presses a recording material for fixing an unfixed image thereon with the recording material nipped between said fixing film and said pressure rotary body, said unfixed image formed on the recording material, said control method comprising:

a step for maintaining a heater at a predetermined fixing temperature when the recording material is nipped for fixing;

a temperature sensing step for sensing a temperature of said heater;

a print speed control step for comparing the temperature sensed by said temperature sensing step with a predetermined threshold to control a print speed according to the comparison result;

a threshold switching step for switching the threshold according to a predetermined condition; and a step for accumulating the number of executions of throughput reduction, said throughput reduction executed for reducing the print speed by said print speed control step;

wherein, as the predetermined condition, said threshold switching step uses a condition that the number of executions of throughput reduction reaches a predetermined value.

4. A control method for an image forming device comprising a fixing film and a pressure rotary body that presses on the fixing film wherein said image forming device heats and presses a recording material for fixing an unfixed image thereon with the recording material nipped between said fixing film and said pressure rotary body, said unfixed image formed on the recording material, said control method comprising:

a step for maintaining a heater at a predetermined fixing temperature when the recording material is nipped for fixing;

a temperature sensing step for sensing a temperature of said heater;

a print speed control step for comparing the temperature sensed by said temperature sensing step with a predetermined threshold to control a print speed according to the comparison result;

a threshold switching step for switching the threshold according to a predetermined condition;

a step for sensing recording material size information;

a step for counting the number of recording material prints; and a step for measuring a small size paper passing ratio of the number of prints of sheets of paper equal to or smaller than a predetermined size to the number of prints of paper of all sizes;

wherein, as the predetermined condition, said threshold switching step uses whether or not the small size paper passing ratio is higher than a predetermined value.

5. An image forming device comprising:

a heater;

a fixing film that conducts heat of said heater; and a pressure rotary body that presses on said fixing film;

wherein said image forming device heats and presses a recording material for fixing an unfixed image thereon with the recording material nipped between said fixing film and said pressure rotary body, said unfixed image formed on the recording material, said image forming device further comprising:

temperature adjusting means for maintaining said heater at a predetermined fixing temperature when the recording material is nipped for fixing;

temperature sensing means for sensing a temperature of said heater;

print speed control means for comparing the temperature sensed by said temperature sensing means with a predetermined threshold to control a print speed according to the comparison result; and threshold switching means for switching the threshold according to an updated value regarding control of image forming, further comprising counting means for accumulating the number of executions of throughput reduction, said throughput reduction executed for reducing the print speed by said print speed control means;

wherein said updated value is an accumulated number of occurrence of the throughput reduction.

6. An image forming device comprising:

a heater;

a fixing film that conducts heat of said heater; and a pressure rotary body that presses on said fixing film;

wherein said image forming device heats and presses a recording material for fixing an unfixed image thereon with the recording material nipped between said fixing film and said pressure rotary body, said unfixed image formed on the recording material, said image forming device further comprising:

temperature adjusting means for maintaining said heater at a predetermined fixing temperature when the recording material is nipped for fixing;

temperature sensing means for sensing a temperature of said heater;

print speed control means for comparing the temperature sensed by said temperature sensing means with a predetermined threshold to control a print speed according to the comparison result; and threshold switching means for switching the threshold according to an updated value regarding control of image forming, further comprising:

means for sensing recording material size information;

counting means for counting the number of recording material prints; and small-size-paper passing ratio measuring means for measuring a small size paper passing ratio of the number of prints of sheets of paper equal to or smaller than a predetermined size to the number of prints of paper of all sizes;

wherein said updated value is the small size paper passing ratio updated each time a print is performed.

* * * * *